US007882571B2

(12) United States Patent
Robba et al.

(10) Patent No.: US 7,882,571 B2
(45) Date of Patent: Feb. 8, 2011

(54) GOLF GLOVE WITH THUMB SUPPORT

(75) Inventors: Marc C. Robba, Sleman Yogyakarta (ID); Karen Pitts, Milton, MA (US); Daniel Ladd, Weston, MA (US)

(73) Assignee: Etonic Worldwide, LLC, Waltham, MA (US)

( * ) Notice: Subject to any disclaimer, the term of this patent is extended or adjusted under 35 U.S.C. 154(b) by 0 days.

(21) Appl. No.: 11/335,339

(22) Filed: Jan. 18, 2006

(65) Prior Publication Data

US 2007/0174948 A1 Aug. 2, 2007

(51) Int. Cl.
*A63B 71/14* (2006.01)

(52) U.S. Cl. ..... 2/161.2; 2/161.1

(58) Field of Classification Search ..... 2/161.2, 2/161.3, 167, 161.1, 161.5, 161.6, 20, 21, 2/159, 160, 161.7, 161.8, 163, 166
See application file for complete search history.

(56) References Cited

U.S. PATENT DOCUMENTS

| | | | | |
|---|---|---|---|---|
| 595,925 | A * | 12/1897 | Schrecker | 2/167 |
| 3,930,271 | A | 1/1976 | Kahng | |
| 3,931,647 | A | 1/1976 | Dien | |
| 3,952,333 | A | 4/1976 | Fujita | |
| 3,985,364 | A | 10/1976 | Brady | |
| 4,000,903 | A | 1/1977 | Swanson | |
| 4,025,077 | A | 5/1977 | Thompson | |
| 4,040,126 | A | 8/1977 | Cecil | |
| 4,042,977 | A | 8/1977 | Antonious | |
| 4,051,552 | A | 10/1977 | Widdemer | |
| 4,057,255 | A | 11/1977 | Bishop | |
| 4,089,070 | A | 5/1978 | Cherry | |
| 4,095,292 | A | 6/1978 | Klein | |
| 4,146,935 | A | 4/1979 | Hinton | |
| 4,173,344 | A | 11/1979 | Angshed | |
| 4,183,100 | A | 1/1980 | De Marco | |
| 4,187,557 | A | 2/1980 | Tombari | |
| 4,197,592 | A | 4/1980 | Klein | |
| 4,228,548 | A | 10/1980 | Cohen | |
| 4,329,741 | A | 5/1982 | Bach | |
| RE31,538 | E | 3/1984 | Antonious | |
| 4,453,275 | A | 6/1984 | Kawada | |

(Continued)

OTHER PUBLICATIONS

International Search Report for Application No. PCT/US07/01208, dated Oct. 4, 2007.

*Primary Examiner*—Gary L Welch
*Assistant Examiner*—Sally C Cline
(74) *Attorney, Agent, or Firm*—Nelson Mullins Riley & Scarborough LLP; Thomas V. Smurzynski; Anthony A. Laurentano

(57) ABSTRACT

A golf glove has a number of regions formed of a leather-like material, connected with a more flexible region of spandex-like material. A thumb region has a base portion at least substantially surrounded by the flexible region. The thumb region further includes an auxiliary support structure on a portion of the thumb region providing additional support to the thumb of a user and anti-twist functionality reducing or eliminating movement of the glove relative to the thumb of a user. In addition, a grip region can extend from a wrist end of the glove substantially to finger tips of a little finger portion, a ring finger portion, and a middle finger portion of the glove.

18 Claims, 3 Drawing Sheets

U.S. PATENT DOCUMENTS

| | | | | |
|---|---|---|---|---|
| 4,514,861 | A | 5/1985 | Kamada | |
| 4,564,956 | A | 1/1986 | DiBuono | |
| 4,589,146 | A | 5/1986 | Taylor | |
| 4,590,625 | A | 5/1986 | Keim | |
| 4,639,947 | A | 2/1987 | Lanscioni | |
| 4,654,895 | A | 4/1987 | Peters | |
| 4,658,445 | A * | 4/1987 | Tribble | 2/161.2 |
| 4,660,228 | A | 4/1987 | Ogawa et al. | |
| 4,665,565 | A | 5/1987 | Odom | |
| 4,691,387 | A | 9/1987 | Lopez | |
| 4,691,388 | A | 9/1987 | Boone | |
| 4,700,405 | A | 10/1987 | Sternberg | |
| 4,730,354 | A | 3/1988 | Saito | |
| 4,751,750 | A | 6/1988 | Tepley | |
| 4,793,005 | A | 12/1988 | Hetzel, Jr. | |
| 4,796,306 | A | 1/1989 | Mitchell | |
| 4,850,053 | A | 7/1989 | Tepley et al. | |
| 4,858,246 | A | 8/1989 | Wiggins | |
| 4,864,659 | A | 9/1989 | Morris | |
| 4,864,660 | A | 9/1989 | Sawyer | |
| 4,882,787 | A | 11/1989 | Hull et al. | |
| 4,962,547 | A | 10/1990 | Minnick | |
| 5,004,231 | A | 4/1991 | Alread | |
| 5,028,050 | A | 7/1991 | Freyer | |
| 5,033,120 | A | 7/1991 | Myers | |
| 5,088,122 | A | 2/1992 | O'Toole | |
| 5,140,709 | A | 8/1992 | Cohn et al. | |
| 5,143,371 | A | 9/1992 | Strahan | |
| 5,146,627 | A | 9/1992 | Weiser | |
| 5,152,532 | A | 10/1992 | Rouse | |
| 5,156,399 | A | 10/1992 | Gauer | |
| 5,164,231 | A | 11/1992 | Davis | |
| 5,170,508 | A | 12/1992 | Kawada | |
| 5,175,886 | A * | 1/1993 | Suk | 2/161.2 |
| 5,180,169 | A | 1/1993 | Choy | |
| 5,184,353 | A | 2/1993 | Goldwitz | |
| 5,195,188 | A | 3/1993 | Bourdeau et al. | |
| 5,203,570 | A | 4/1993 | Graham | |
| 5,251,335 | A | 10/1993 | DeFusco | |
| 5,253,367 | A | 10/1993 | Lappley | |
| 5,254,391 | A | 10/1993 | Davis | |
| 5,257,418 | A | 11/1993 | Jaskiewicz | |
| 5,353,440 | A | 10/1994 | Meldeau | |
| 5,390,372 | A | 2/1995 | Hashimoto et al. | |
| 5,414,868 | A | 5/1995 | Crawford | |
| 5,423,089 | A | 6/1995 | Chun et al. | |
| 5,435,013 | A | 7/1995 | Davis | |
| 5,450,628 | A | 9/1995 | Lowinger | |
| 5,462,280 | A | 10/1995 | Dickerson | |
| 5,490,290 | A | 2/1996 | Gold | |
| 5,511,247 | A | 4/1996 | Block | |
| 5,515,548 | A | 5/1996 | Lazarus | |
| D371,640 | S | 7/1996 | Boone | |
| 5,592,695 | A | 1/1997 | Roche | |
| 5,609,529 | A | 3/1997 | Brown | |
| 5,621,918 | A | 4/1997 | Bernhard | |
| 5,634,214 | A | 6/1997 | St. Ville | |
| 5,636,381 | A | 6/1997 | Brogden | |
| 5,644,795 | A | 7/1997 | Landis et al. | |
| 5,664,260 | A | 9/1997 | Weiser | |
| 5,682,614 | A | 11/1997 | Lazarus | |
| 5,692,242 | A | 12/1997 | Tekerman et al. | |
| 5,706,521 | A | 1/1998 | Haney | |
| 5,708,979 | A * | 1/1998 | Redwood et al. | 2/161.1 |
| 5,733,201 | A | 3/1998 | Caldwell et al. | |
| 5,740,555 | A | 4/1998 | Renegar | |
| 5,742,941 | A | 4/1998 | Porter | |
| 5,742,942 | A | 4/1998 | Sykes | |
| 5,761,745 | A | 6/1998 | Sato | |
| 5,771,492 | A | 6/1998 | Cozza | |
| 5,774,895 | A | 7/1998 | Baldwin | |
| 5,790,980 | A | 8/1998 | Yewer, Jr. | |
| 5,802,614 | A | 9/1998 | Melone, Jr. | |
| 5,802,615 | A | 9/1998 | Wenk | |
| 5,850,635 | A | 12/1998 | Lazarus | |
| 5,855,022 | A | 1/1999 | Storto | |
| 5,873,788 | A | 2/1999 | Hoffman | |
| 5,886,089 | A | 3/1999 | Knowlton | |
| 5,890,228 | A | 4/1999 | Wagner | |
| 5,893,172 | A | 4/1999 | Haynes et al. | |
| 5,896,584 | A | 4/1999 | Hauser | |
| 5,898,943 | A | 5/1999 | Kim | |
| 5,898,944 | A | 5/1999 | Vrany | |
| 5,920,908 | A | 7/1999 | Widdemer | |
| 5,926,847 | A | 7/1999 | Eibert | |
| 5,926,912 | A | 7/1999 | Claphan | |
| 5,983,395 | A | 11/1999 | Lei | |
| 6,035,443 | A | 3/2000 | Green | |
| 6,044,494 | A | 4/2000 | Kang | |
| 6,052,827 | A | 4/2000 | Widdemer | |
| 6,065,155 | A | 5/2000 | Sandusky | |
| 6,085,355 | A | 7/2000 | Chen | |
| 6,092,238 | A | 7/2000 | Fierabend, Jr. | |
| 6,119,271 | A | 9/2000 | Byon | |
| 6,154,885 | A * | 12/2000 | Kobayashi et al. | 2/161.3 |
| 6,223,354 | B1 | 5/2001 | Carothers | |
| 6,253,382 | B1 | 7/2001 | Kleinert | |
| 6,269,487 | B1 | 8/2001 | Schryver et al. | |
| 6,272,686 | B1 | 8/2001 | Liu | |
| 6,363,535 | B1 | 4/2002 | Landis | |
| 6,389,601 | B2 | 5/2002 | Kleinert | |
| 6,405,380 | B1 * | 6/2002 | Kuroda et al. | 2/161.1 |
| 6,408,442 | B1 | 6/2002 | Kang | |
| 6,415,445 | B1 | 7/2002 | Nishijima et al. | |
| 6,427,246 | B1 | 8/2002 | Doi et al. | |
| 6,427,247 | B1 * | 8/2002 | Suk | 2/161.2 |
| 6,427,248 | B1 | 8/2002 | Albert | |
| 6,473,906 | B2 | 11/2002 | Kambe et al. | |
| 6,505,350 | B2 | 1/2003 | Litke | |
| 6,513,166 | B1 | 2/2003 | Landis | |
| 6,539,551 | B1 | 4/2003 | Jones, Jr. | |
| 6,543,058 | B2 | 4/2003 | Litke | |
| 6,625,815 | B2 | 9/2003 | Litke | |
| 6,654,959 | B1 | 12/2003 | Alpert | |
| 6,675,392 | B2 | 1/2004 | Albert | |
| 6,698,027 | B2 | 3/2004 | Park | |
| 6,704,939 | B2 | 3/2004 | Faulconer | |
| 6,708,346 | B2 | 3/2004 | Terris et al. | |
| 6,725,465 | B2 | 4/2004 | Taylor | |
| 6,732,377 | B1 | 5/2004 | Wilkinson | |
| 6,745,402 | B2 | 6/2004 | Caswell | |
| 6,775,847 | B2 | 8/2004 | Terris et al. | |
| 6,862,744 | B2 * | 3/2005 | Kuroda et al. | 2/161.1 |
| 2001/0032347 | A1 | 10/2001 | Redwood et al. | |
| 2001/0054190 | A1 | 12/2001 | Kleinert | |
| 2002/0010956 | A1 | 1/2002 | Roland | |
| 2002/0042940 | A1 | 4/2002 | Kuroda et al. | |
| 2002/0056156 | A1 | 5/2002 | Kambe et al. | |
| 2002/0094444 | A1 | 7/2002 | Nakata et al. | |
| 2002/0100105 | A1 | 8/2002 | Terris et al. | |
| 2002/0116745 | A1 | 8/2002 | Taylor | |
| 2002/0129436 | A1 | 9/2002 | Terris et al. | |
| 2002/0129437 | A1 | 9/2002 | Erker | |
| 2002/0152536 | A1 | 10/2002 | Kuroda et al. | |
| 2002/0152537 | A1 | 10/2002 | Litke | |
| 2002/0194668 | A1 | 12/2002 | Kwon | |
| 2003/0005506 | A1 | 1/2003 | Litke | |
| 2003/0005507 | A1 | 1/2003 | Litke | |
| 2003/0037364 | A1 | 2/2003 | Albert | |
| 2003/0056273 | A1 | 3/2003 | Kleinert | |
| 2003/0061651 | A1 | 4/2003 | DeRose | |
| 2003/0106132 | A1 | 6/2003 | Terris et al. | |
| 2003/0208833 | A1 | 11/2003 | Gold | |
| 2003/0208834 | A1 | 11/2003 | Park | |

2004/0025222 A1 2/2004 Cass
2004/0025225 A1 2/2004 Thompson
2004/0060097 A1 4/2004 Bamber
2004/0107476 A1 6/2004 Goldwitz
2004/0111786 A1 6/2004 Terris et al.
2004/0132538 A1 7/2004 Oury et al.
2004/0142756 A1 7/2004 Oury
2004/0177430 A1 9/2004 Gordon
2004/0199978 A1 10/2004 Cass
2004/0216216 A1 11/2004 Terris et al.

* cited by examiner

GOLF GLOVE WITH THUMB SUPPORT

FIELD OF THE INVENTION

The present invention relates to gloves suitable for use in golfing, and more particularly to a unique golf glove construction providing flexibility to a thumb region, while also supporting the thumb with an auxiliary anti-twist support, reducing or eliminating twisting movement of the glove relative to the thumb of a user.

BACKGROUND OF THE INVENTION

Generally, golfers use at least one golf glove on their leading hand when playing golf. A majority of golfers use gloves to improve their grip of the golf glove relative to the bare human hand, which often provides less grip especially when sweating or when club grips are wet. When a glove is used to provide a more secure grip, the golfer wearing the glove correspondingly has more control of the golf club, thus theoretically enabling improvement of their golf game. The glove can also provide some added protection from vibration and abrasion, although such protection is relatively minimized by the thinness of the glove material.

The conventional golf glove is formed of a very thin leather and/or synthetic material, that enables the user to feel the grip of the club through the glove. Common golf glove materials include leather, synthetic leather, spandex, blends with spandex, elastane, and other flexible and/or stretchable material. The material provides a smooth, wrinkle-free interface between the user's hand and the grip of the golf club.

In general, the materials similar to and including leather provide better gripping properties but are less flexible, while the materials similar to and including spandex provide better flexibility but are more slippery, affecting grip and adhesion.

Accordingly, golf glove design involves a balancing of such features as improving tackiness or adhesion to the golf glove grip, while also providing flexibility to the user's hand where desired, and maintaining a high degree of touch sensitivity enabling the user to feel the grip of the golf club in certain fingers during play. The interrelation between some of these features with each other can influence the final fit and performance of the golf glove. Such combination of features and characteristics has resulted in a large number of different golf glove designs, each with its own subtle differences and advantages.

In some instances certain features or characteristics desired in a golf glove can compete with one another to create a situation where sacrifices are made in the overall design of the golf glove. As such, certain performance aspects may be the focus of one golf glove design, while other performance aspects are the focus of another golf glove design. Two such performance aspects are the ability to move one's fingers in an unrestricted manner while still providing adequate support features within the glove.

SUMMARY OF THE INVENTION

There is a need for a golf glove having desired flexibility at specified locations on a user's hand, while also having desired grip ability and touch sensitivity, and forming a cohesive performance glove, including improved support to prevent or reduce movement of the golf glove relative to a user's hand and fingers. The present invention is directed toward further solutions to address this need.

In accordance with one embodiment of the present invention, a golf glove includes a thumb region formed of a first material and having a base, a grip side, and a back side. A flexible region of the glove is formed of a second material having greater flexibility than the first material. The flexible region at least substantially circumscribes the base of the thumb region. The thumb region further includes an auxiliary support structure coupled with the thumb region along a portion of the thumb region to provide anti-twist support of the thumb region relative to the user's thumb during use. The portion of the thumb region can include, for example, the back side of the thumb.

In accordance with aspects of the present invention, the thumb region is formed of a material having properties at least substantially similar to the properties of leather, while the second material has properties at least substantially similar to the properties of spandex or elastane. The auxiliary support structure can be formed of material having properties at least substantially similar to the properties of spandex or elastane.

In accordance with further aspects of the present invention, the auxiliary support structure couples with the thumb region on an interior side. Alternatively, the auxiliary support structure couples with the thumb region on an exterior side. In addition, the thumb region can further include a support stitch formed along the thumb region in an elongate pattern passing on both sides of a knuckle region.

In accordance with aspects of the present invention, the auxiliary support structure provides torsional support of a thumb of a user of the golf glove.

In accordance with further aspects of the present invention, the golf glove further includes a finger region formed of at least an index finger region with a base. A palm region extends generally from a wrist end of the glove across a palm area of the glove. The flexible region at least substantially circumscribes the base of the thumb region, up to the base of the index finger region, and between the base of the thumb region and the palm region.

In accordance with one embodiment of the present invention, a method of manufacturing a golf glove includes providing a thumb region having a base, a grip side, and a back side, and formed of a first material. A flexible region formed of a second material having greater flexibility than the first material is fastened to the thumb region along the base. The flexible region at least substantially circumscribes the base of the thumb region. The thumb region comprises an auxiliary support structure coupled with the thumb region along the back side of the thumb region.

In accordance with aspects of the method of the present invention, the first material has properties at least substantially similar to the properties of leather, while the second material has properties at least substantially similar to the properties of spandex or elastane, or equivalents thereof. The auxiliary support structure can be formed of material having properties at least substantially similar to the properties of spandex or elastane, or equivalents thereof.

In accordance with further aspects of the method of the present invention, the auxiliary support structure couples with the back side of the thumb region on an interior side of the back side. Alternatively, the auxiliary support structure couples with the back side of the thumb region on an exterior side of the back side. In addition, the thumb region can further include a support stitch formed along the back side of the thumb region in an elongate pattern passing on both sides of a knuckle region.

In accordance with aspects of the method of the present invention, the auxiliary support structure provides torsional support of a thumb of a user of the golf glove.

In accordance with further aspects of the method of the present invention, the golf glove further includes a finger region formed of at least an index finger region with a base. A palm region extends generally from a wrist end of the glove across a palm area of the glove. The flexible region at least substantially circumscribes around the base of the thumb region, up to the base of the index finger region, and between the base of the thumb region and the palm region.

In accordance with one embodiment of the present invention, a golf glove is provided that includes a thumb region having a base. A finger region can be formed of at least an index finger region with a base. A palm region extends generally from a wrist end of the glove across a palm area of the glove. A flexible region can be formed of material having greater flexibility than material forming the thumb region and the palm region. The flexible region at least substantially circumscribes around the base of the thumb region, up to the base of the index finger region, and between the base of the thumb region and the palm region. The thumb region includes an auxiliary support structure coupled with the thumb region along a back side of the thumb region to provide support of the thumb of a user.

In accordance with one embodiment of the present invention, a method of manufacturing a golf glove includes providing a thumb region having a base. A finger region is provided formed of at least an index finger region with a base. A palm region extends generally from a wrist end of the glove across a palm area of the glove. A flexible region formed of material having greater flexibility than material forming the thumb region and the palm region is fastened to circumscribe uninterrupted around the base of the thumb region, up to the base of the index finger region, and between the base of the thumb region and the palm region. The thumb region includes an auxiliary support structure coupled with the thumb region along a back side of the thumb region.

BRIEF DESCRIPTION OF THE DRAWINGS

The present invention will become better understood with reference to the following description and accompanying drawings, wherein.

DETAILED DESCRIPTION

Figure 1:
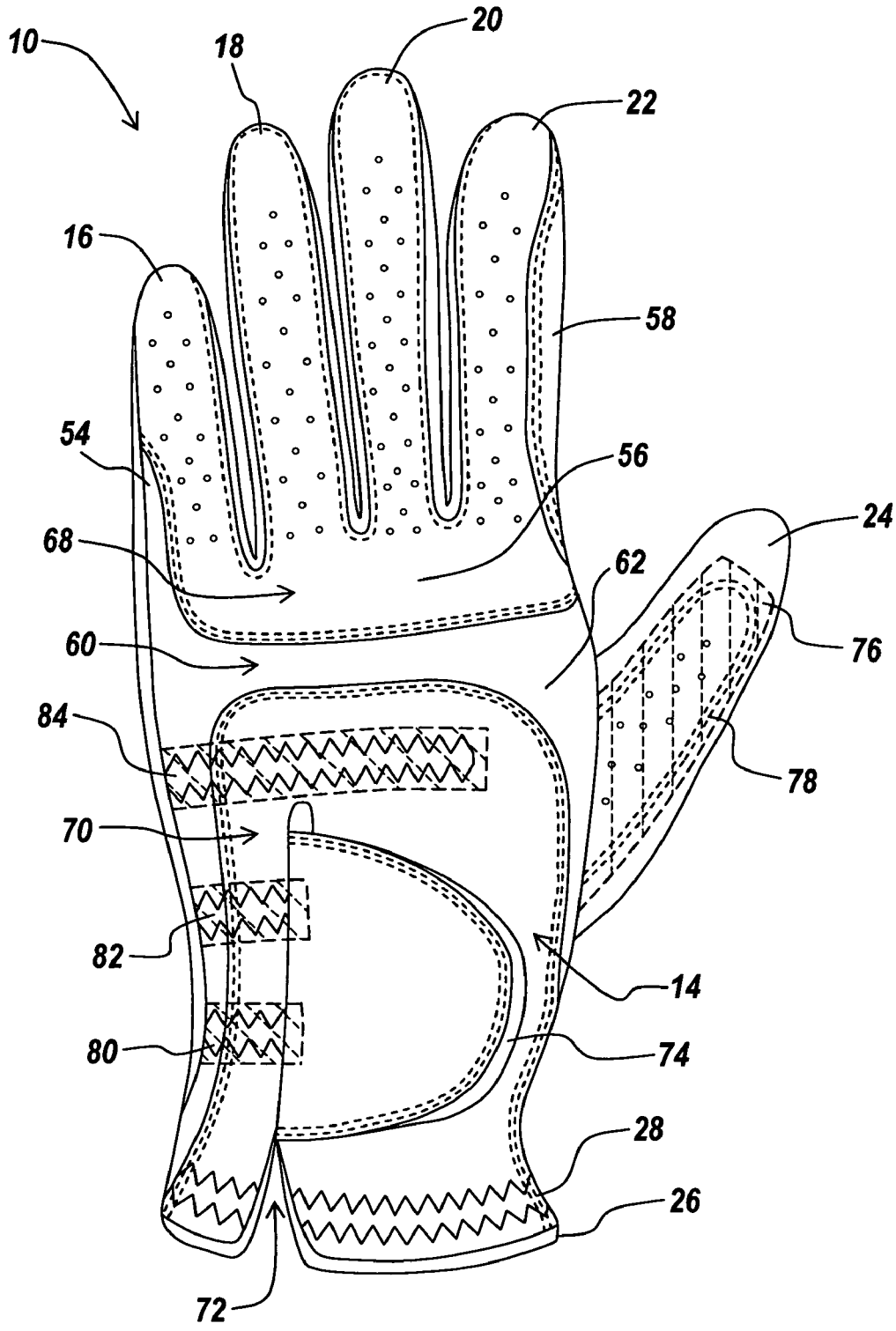
FIG. 1 is a diagrammatic illustration of a back side of a golf glove, with an internal thumb support, according to one aspect of the present invention.

An illustrative embodiment of the present invention relates to a golf glove having a number of components that can work together or individually to form a high performance glove. There are numerous conventional golf gloves ranging from a straightforward glove formed of uniform material and standard fastening mechanisms, to golf gloves having individual added features to address specific health concerns, performance, durability, usability, manufacturing related advances, and the like. When portions of a golf glove are made to be more flexible, attention must be paid as to whether making such portions of the glove more flexible could be detrimental to other aspects of the glove, such as support. For example, it is known to use spandex material instead of leather in portions of a golf glove to improve flexibility of the glove; however it is also known that spandex is slippery, and thus cannot be the contact point for portions of the glove (such as the gripping fingers) that require good grip and adhesion characteristics. It is this interplay of features and their relative influence that combine to form the golf glove, and because of the interplay, specific combinations of features provide different and sometimes unexpected results.

FIGS. 1 through 4, wherein like parts are designated by like reference numerals throughout, illustrate an example embodiment of a golf glove according to the present invention. Although the present invention will be described with reference to the example embodiment illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

Figure 2:
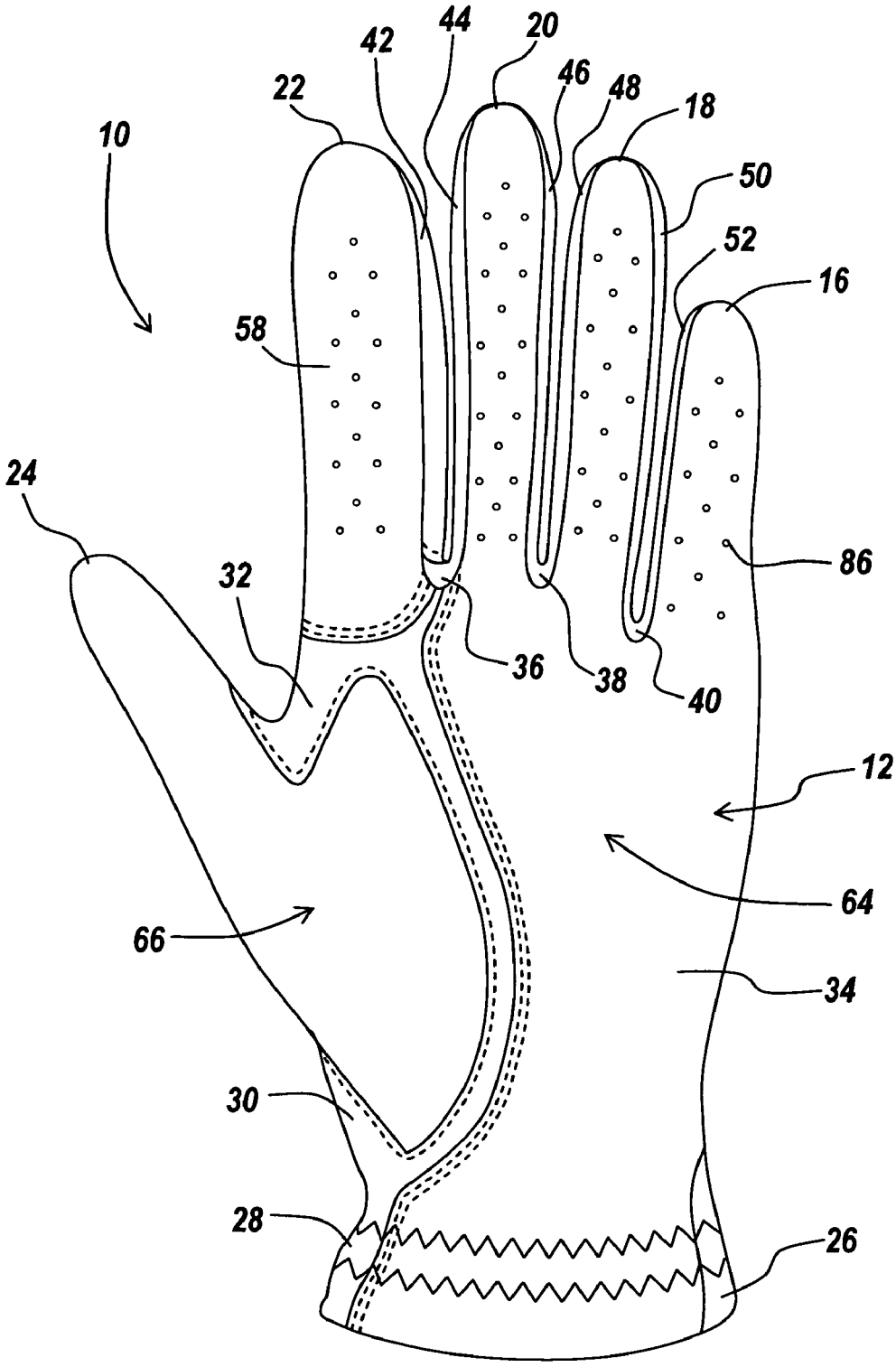
FIG. 2 is a diagrammatic illustration of a front side of the golf glove, according to one aspect of the present invention.
Figure 3:
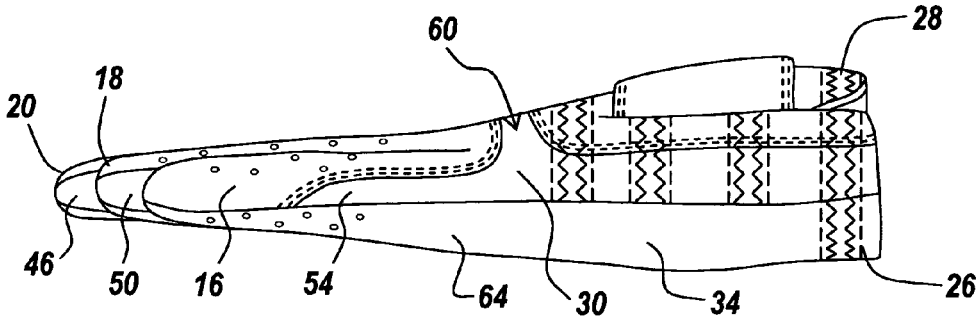
FIG. 3 is a diagrammatic illustration of a side of the golf glove, according to one aspect of the present invention.

FIGS. 1 and 2 illustrate a top and bottom view, respectively, of a golf glove 10 in accordance with the present invention. The golf glove 10 has a palm side 12 and a back side 14. As with conventional gloves, the golf glove 10 of the present invention likewise has a little finger portion 16, a ring finger portion 18, a middle finger portion 20, an index finger portion 22, and a thumb portion 24. The golf glove 10 additionally has a cuff 26 with elastic stitching 28 to cinch the golf glove 10 around a wrist of a user and create a better fitting glove.

The golf glove 10 of the present invention is formed of a number of different components and regions of material that combine to create a high performance golf glove. FIGS. 1, 2, 3, and 4, all show the golf glove 10 of the present invention. In addition to the top and bottom views of FIGS. 1 and 2, FIGS. 3 and 4 show side views from the perspective of the little finger side in FIG. 3, and from the perspective of the thumb side in FIG. 4.

The thumb portion 24 of the golf glove 10 is formed of leather, or material having similar characteristics to leather or equivalents thereof. One of ordinary skill in the art will appreciate that the present invention is not limited to leather as the material for this or other portions of the glove. Rather, when the material leather is referred to herein, what is intended is reference to a material having the same or similar characteristics as those found in conventional golf glove leather. Some of those characteristics include a degree of softness, ability to wrap around a hand or finger for a snug fit, ability to slightly stretch, adhesion properties suitable for gripping a golf club, abrasion protection, and the ability to substantially translate touch and feel senses from the golf club through to the hand or finger, such that the user is not completely isolated from the feel of the golf club.

The thumb portion 24 extends generally from a base portion of the thumb to the tip of the thumb of a user. For at least a substantial amount of the thumb portion 24 there is no direct abutment or coupling with any other portion of the golf glove 10 made of the same or similar material as the thumb portion 24. Rather, the thumb portion 24 is substantially separated relative to the remaining portions of the golf glove 10 of similar material by being coupled along at least a substantial portion of the base with a different, more flexible, material. In the example embodiment, the thumb portion 24 couples with a spandex region 30. In the example embodiment, the spandex region 30 completely circumscribes the base portion of the thumb portion 24. However, it is believed that the effectiveness of the spandex region 30 may be achieved by configuring the spandex region 30 to be substantially between the thumb portion 24 and the remainder of the golf glove 10, with the functionality of enabling the freedom of movement of the thumb as described herein.

As with the references to leather in the present description, the references to spandex are likewise not limited only to spandex. Rather, the term spandex is intended to refer to a material having the same or similar characteristics as those found in conventional spandex or elastane, or equivalents thereof, including LYCRA stretch fibers by INVISTA of Wichita, Kans. The primary characteristics of this material are its increased flexibility and shape memory. Some additional characteristics include being a material made of stretch fibers that provide fabrics and garments with fit, comfort, freedom of movement, and crease recovery, in addition to an ability to stretch up to about 600% in some instances and return back to a pre-stretched shape, and being combinable with other natural and synthetic fibers to achieve different levels of stretch and recovery, while retaining the hand (e.g., fineness, texture, and durability) and appearance of the primary material fiber.

The spandex region 30 extends or circumscribes around at least a substantial portion of the base of the thumb portion 24. As such, the thumb portion 24 is free to rotate, pivot, and otherwise move freely relative to the remainder of the golf glove 10. Said differently, the thumb portion 24 is able to move substantially unencumbered relative to other conventional golf gloves having leather thumb portions substantially sewn or coupled with one or all of the index finger portion 22, a palm portion 34, or back side 14 of the golf glove. In the directions in which a user's thumb can conventionally move, the spandex region 30 forms the area of the golf glove 10 that must stretch to accommodate such movement. As such, the location of the spandex region 30 around at least a substantial portion of the base of the thumb portion 24 creates the desired effect.

The spandex region 30 also extends upward from the thumb portion 24 into a first valley 32 between the thumb portion 24 and the index finger portion 22. The spandex region continues into a second valley 36 between the index finger portion 22 and the middle finger portion 20. The spandex region 30 can additionally extend, as illustrated, down to and through the elastic stitching 28 and the cuff 26 of the golf glove 10.

The index finger portion 22 is thus also substantially unencumbered relative to other conventional golf gloves having leather finger portions substantially coupled with one or both of leather thumb portions or leather palm portions 34. As with the thumb portion 24, the spandex region 30 enables the index finger portion 22 to flex in all directions that a finger will normally flex, i.e., sideways, and forward toward the palm, but not to a substantial extent backward toward the back side 14 of the glove or hand. On the back side of the index finger portion 22, the leather material of the index finger portion 22 couples with a leather connector portion 56 that couples the back sides of the little finger portion 16, the ring finger portion 18, the middle finger portion 20, and the index finger portion 22.

Turning now to the other finger portions of the golf glove 10, a combination of leather and spandex materials form the finger portions as follows. The index finger portion 22 couples with a leather fourchette 42. At the base of the leather fourchette 42, the index finger portion 22 and the leather fourchette 42 couple with the first valley 32, formed of spandex material. The first valley 32 continues upward on the middle finger portion 20 forming a second fourchette 44 of spandex material. A third fourchette 46 is disposed on an opposite side of the middle finger portion 20, continues through a third valley 38, and up to form a fourth fourchette 48 on the ring finger portion 18. A fifth fourchette 50 is disposed on an opposite side of the ring finger portion 18, continues through a fourth valley 40, and up the little finger portion 16 to form a sixth fourchette 52. A seventh fourchette 54 begins halfway down an opposite side of the little finger portion 16 and continues seamlessly into the spandex region 30.

Each of the fourchette and valley combinations is a seamless transition of spandex or other similar material. The flexibility of the spandex material in the fourchette regions of the finger portions provides greater comfort and fit of the golf glove 10 for the user. As a user bends their fingers to grip a golf club, the sides of their fingers, especially around the joints, bulge outwardly, creating a fatter finger. The flexible spandex fourchettes 42, 44, 46, 48, 50, 52, and 54, and corresponding valleys 36, 38, and 40, accommodate this expansion. Thus providing a snug fit around each of the user's fingers, while not becoming too tight while gripping the golf club. If the finger portions 16, 18, 20, and 22 were to become too tight while gripping a golf club, the grip would be affected, and the ability to feel the golf club would be reduced, thus resulting in a less effective golf glove. The spandex fourchettes of the golf glove 10 of the present invention address this issue, and allow for greater flexibility where needed, without sacrificing the grip characteristics of the leather material on the gripping portions of the finger portions to maintain good adhesion with the golf club.

Returning now to the spandex region 30, as mentioned, the seventh fourchette 54 begins halfway down the little finger and joins the spandex region 30. The seventh fourchette 54 is located to cover the portion of the little finger of a user that bulges during gripping of the golf club, thus providing a lesser amount of flex resistance than would otherwise be found if the seventh fourchette 54 were leather. The spandex region continues down the side of the golf glove 10 to the cuff 26. The spandex region 30 also continues around the back side 14 of the golf glove 10 and extends across a knuckle region 60.

The knuckle region 60 of the spandex region 30 extends across the four knuckles of a user's hand at the base of each of the user's fingers. Accordingly, as the user grips a golf club, the knuckles flex and the spandex material likewise flexes at the knuckles, providing little resistance to the gripping operation. The spandex region 30 spans between the knuckle region 60 and the coupling with the thumb portion 24 across a transition region 62. The existence of the more flexible spandex material in the transition region 62 between the knuckle of the index finger and the thumb enables ease of movement, further contributing to the island thumb portion 24 of the present invention.

The existence of the spandex region on both sides of the glove and on a portion of the palm side 12 and a portion of the back side 14 creates a number of separated leather regions. A first leather region 64 extends from the cuff 26 on the palm side 12 of the golf glove 10 upward to form each of the grip sides of the middle finger 20, the ring finger 18, and the little finger 16. A second leather region 66 forms the palm side 12 and the back side of the thumb portion 24. As such, the entire thumb, from the heel to the end on both sides is surrounded by leather. In addition, the thumb portion has an auxiliary support structure, as will be detailed later herein. A third leather region 68 extends across the back side 14 of the golf glove 10, connecting the back side of the little finger 16, the ring finger 18, the middle finger 20, and the index finger 22. A fourth leather region 70 is disposed on the back side 14 of the golf glove 10, and is separated in part by a slit 72 that is fastened with a hook and loop fastener coupling 74. One of ordinary skill in the art will appreciate that the present invention is not limited to use of a hook and loop fastener coupling 74. Rather, other mechanical fastening means, such as hooks, buttons, zippers, snaps, and the like are also anticipated for use with the present invention.

The user can disengage the hook and loop fastener coupling 74 and widen the opening at the cuff 26 along the slit 72 to place the golf glove 10 on their hand. The user can then pull the hook and loop fastener coupling 74 across the golf glove 10, closing the slit 72 and tightening the golf glove 10 around their hand, and fasten the hook and loop fastener coupling 74 to hold the golf glove 10 in place.

The leather regions 64, 66, 68, and 70 are maintained to provide stability and structure to the glove that otherwise would not occur if these regions were made of the more flexible spandex material, as well as providing good adhesion for gripping the golf club, and protecting against abrasion. More specifically, the first leather region 64 provides a solid, smooth, continuous surface with good adhesion for gripping along the primary areas of the hand that grip the golf club, namely, the palm and little, ring, and middle fingers. There is no interruption with seams or material changes to disrupt the sensory communication between the user's hand and the golf club grip, which would degrade the golf glove 10 performance by distracting the user with interfering ridges.

The second leather region 66 forms a continuous supportive structure with good adhesion characteristics around the thumb. During the golf swing, the golf club exerts pressure against the thumb, pushing it backward or outward from the hand. Accordingly, it can be desirable to have additional support for the thumb. The present invention can include an auxiliary support structure 76, shown in hidden lines in FIG. 1 and shown in solid line in FIG. 4.

The auxiliary support structure 76 is a panel sewn into the thumb portion 24 with a continuous support stitch 78, and along a base of the thumb portion 24 where the thumb portion 24 connects with the spandex region 30 as illustrated in the example embodiment. One of ordinary skill in the art will appreciate that other elongate stitch patterns can be utilized. The auxiliary support structure 76 can be formed of a number of different materials, including spandex. The support stitch 78 is generally peninsular in shape so that it extends substantially the length of the thumb portion 24 along the back side of the thumb, but does not interfere with the knuckle of the thumb. Said differently, the support stitch 78 is not disposed down the middle of the thumb portion 24 over the area that would have a thumb knuckle pressed against it when the user bends their thumb. Such a stitch directly over the knuckle could cause discomfort. Instead, the support stitch 78 of the present invention circumscribes the knuckle of the thumb, while simultaneously supporting the thumb portion 24 together with the auxiliary support structure 76 to support the thumb of a user during the swing of a golf club.

Figure 4:
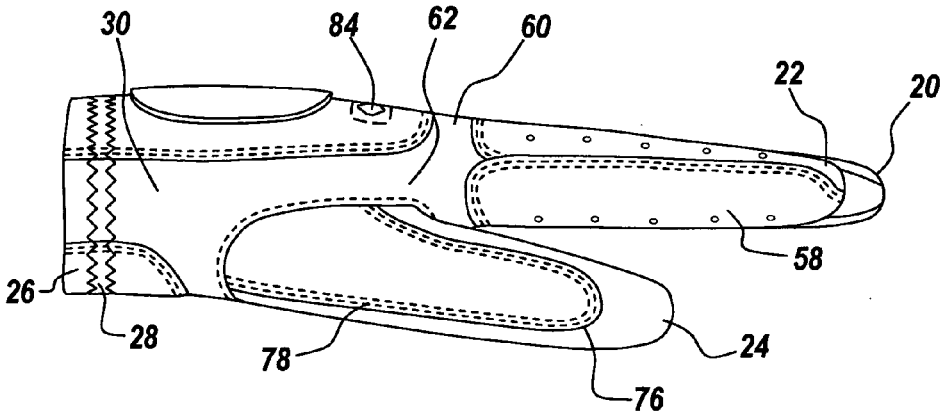
FIG. 4 is a diagrammatic illustration of an opposite side of the golf glove from that of FIG. 3, and having an external thumb support, according to one aspect of the present invention.

The auxiliary support structure 76 can couple with the thumb portion 24 using other mechanical coupling mechanisms, such as by hook and loop fastener, adhesive, weaving, mechanical fastener, and the like, in addition to the stitching described herein. As such, the present invention is not limited to coupling the auxiliary support structure 76 with the thumb portion 24 using only stitching. In addition, the auxiliary support structure 76 can be placed on an interior side of the thumb portion 24 (as shown in FIG. 1) or the auxiliary support structure 76 can be placed on an exterior side of the thumb portion 24 (as shown in FIG. 4). Further, the auxiliary support structure 76 can be placed on portions of the thumb portion 24, including the backside, or other side portions. The functionality of the auxiliary support structure 76 is to provide anti-torsional support to the thumb of the user, both supporting the thumb and also reducing or eliminating movement of the thumb portion 24 of the golf glove 10 in a twisting movement relative to the user's thumb.

Also, to aid in providing a structure enabling good adhesion of the golf glove 10 to a golf club reducing twisting or movement of the golf glove 10 relative to the user's hand, a number of elastic segments are provided. A first elastic segment 80 and a second elastic segment 82 are stitched into the golf glove 10 and extend from a side portion of the golf glove 10 around the back side 14 of the golf glove 10, connecting with the fourth leather region 70. The first elastic segment 80 and the second elastic segment 82 provide tightening support for the hook and loop fastener coupling 74 holding the slit 72 together after the user has put on the golf glove 10.

A third elastic segment 84 extends from a side of the golf glove 10 to the back side 14 along the top of the fourth leather region 70. The third elastic segment 84 helps to hold the golf glove 10 on the user's hand and reduce the likelihood of movement or twisting of the golf glove 10 relative to the user's hand during use.

The golf glove 10 can additionally include a higher sensitivity leather swatch portion 58 forming a part of the index finger portion 22. Those of ordinary skill in the sport of golf will appreciate that it can be desirable to have increased touch sensitivity with their index finger against the grip of the golf club, because some find tuning swing adjustments can be made with the index finger. While the little finger, ring finger, and middle finger are primarily used to grip and hold the golf club, the index finger can make slight adjustments to direct the club accordingly. The higher sensitivity leather swatch portion 58 is formed of a leather, or leather-like, material that has a greater ability to translate touch sensitivity from the club to the user's finger relative to the leather material used to form the leather regions 64, 66, 68, and 70.

Each of the described elements of the golf glove 10 can work in conjunction with one another to form the high performance golf glove 10. The spandex region 30 is specifically placed to maximize flexibility where needed, while enabling the provision of a sturdy structural material, i.e., leather, for portions of the golf glove 10 that require added support or adhesion. The spandex region 30 is shaped to allow maximum movement of the thumb portion 24, while the auxiliary support structure 76 and support stitching 78 provide the necessary additional support for the thumb. The large and continuous first leather region 64 provides solid and smooth contact, with good adhesion, along the palm and three gripping fingers of the user, maximizing the ability to grip the club without inconsistencies in the material or surface. The dots illustrated throughout the figures indicate breathing holes 86 provided in the leather regions to vent the user's hand along portions against the leather. The spandex region is itself breathable as well to further vent the user's hand and reduce the likelihood of overheating and sweating. The seventh fourchette 54 provides additional flexibility at the end of the hand as it grips a club. The change in material along the gripping side of the index finger portion 22 to the more touch sensitive higher sensitivity leather swatch 58 improves the touch sensitivity performance of the golf glove 10, while maintaining good structure and adhesion characteristics. The spandex fourchettes 44, 46, 48, 50, 52, and 54, and valleys 36, 38, and 40, provide additional flexibility where needed, while not sacrificing structural support or grip characteristics of the golf glove 10.

Any of the above elements of the golf glove 10 of the present invention can be implemented individually. In addition, various combinations of these elements result in a golf glove 10 having overall improved performance, catering to a maximum number of issues and desires of golfers requiring golf gloves to play golf.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

What is claimed is:

1. A golf glove, comprising:

a thumb region formed of a first material and having a base, a grip side, and a back side, wherein the thumb region of the glove generally extends from a base portion of a thumb of a user to a tip portion of a thumb of a user, the thumb region comprising a knuckle area on the back side against which knuckles of the thumb of the user press when the user bends their thumb; and a flexible region formed of a second material having greater flexibility than the first material;

wherein the flexible region at least substantially circumscribes the base of the thumb region; and wherein the thumb region further comprises:

an auxiliary support structure coupled with the thumb region along the back side of the thumb region in an elongate shape extending from about the base region along a longitudinal length of the thumb region toward a tip of the thumb region and overlapping the knuckle area, the auxiliary support structure layered with the first material of the thumb region such that the auxiliary support structure is contiguous with the knuckle area and either internal to the thumb region or external to the thumb region, and a stitch coupling the auxiliary support structure with the thumb region, the stitch being generally peninsular in shape and only circumscribing the knuckle area without interfering with the knuckle area.

2. The golf glove of claim 1, wherein the first material has properties of leather and equivalents thereof.

3. The golf glove of claim 1, wherein the second material has properties of spandex and equivalents thereof.

4. The golf glove of claim 1, wherein the auxiliary support structure is formed of material having properties of spandex and equivalents thereof.

5. The golf glove of claim 1, wherein the auxiliary support structure couples with the thumb region on an interior side thereof.

6. The golf glove of claim 1, wherein the auxiliary support structure couples with the thumb region on an exterior side thereof.

7. The golf glove of claim 1, wherein the support stitch is formed along the thumb region in an elongate pattern that passes to at least one side of the knuckle area.

8. The golf glove of claim 1, wherein the auxiliary support structure provides torsional support of a thumb of a user of the golf glove.

9. The golf glove of claim 1, wherein the golf glove further comprises:

a finger region formed of at least an index finger region with a base; and a palm region extending from about a wrist end of the glove across about a palm area of the glove;

wherein the flexible region at least substantially circumscribes the base of the thumb region, up to the base of the index finger region, and between the base of the thumb region and the palm region.

10. A method of manufacturing a golf glove, comprising:

providing a thumb region having a base, a grip side, and a back side, and formed of a first material, wherein the thumb region of the glove generally extends from a base portion of a thumb of a user to a tip portion of a thumb of a user, the thumb region comprising a knuckle area on the back side against which knuckles of the thumb of the user press when the user bends their thumb; and fastening a flexible region formed of a second material having greater flexibility than the first material to the thumb region along the base;

wherein the flexible region at least:

substantially circumscribes the base of the thumb region, extends upward from the thumb region into a first valley between the thumb region and an index finger portion formed of the first material, extends into a second valley between the index finger portion and a middle finger portion, wherein a primary first material region extends from a cuff on a palm side of the golf glove upward to form grip sides of a middle finger, a ring finger, and a little finger of the golf glove;

extends across a knuckle region on the back side of the golf glove defined by a location of four knuckles of the user's hand at the base of each of the user's fingers, wherein a secondary first material region extends across a back side of the golf glove, connecting a back side of the little finger, the ring finger, the middle finger, and an index finger of the golf glove, and extends down a side of the golf glove to a cuff at a wrist area of the golf glove such that the flexible region substantially surrounds a tertiary first material region on the back side of the golf glove on three sides.

11. The method of claim 10, wherein the first material has properties of leather and equivalents thereof.

12. The method of claim 10, wherein the second material has properties of spandex and equivalents thereof.

13. The method of claim 10, wherein the thumb region comprises an auxiliary support structure coupled with the thumb region along the back side of the thumb region in an elongate shape extending from about the base region along a longitudinal length of the thumb region toward a tip of the thumb region and overlapping the knuckle area, and a stitch coupling the auxiliary support structure with the thumb region, the stitch only circumscribing the knuckle area not interfering with the knuckle area, wherein the auxiliary support structure is formed of material having properties of spandex and equivalents thereof.

14. The method of claim 13, wherein the auxiliary support structure couples with the thumb region on an interior side thereof.

15. The method of claim 13, wherein the auxiliary support structure couples with the thumb region on an exterior side thereof.

16. The method of claim 13, further comprising forming the support stitch formed along the back side of the thumb region in an elongate pattern passing to at least one side of the knuckle area and attaching the auxiliary support structure to the thumb region.

17. The method of claim 13, wherein the auxiliary support structure provides torsional support of a thumb of a user of the golf glove.

18. A golf glove, comprising:

a thumb region having a base, wherein the thumb region of the glove generally extends from a base portion of a thumb of a user to a tip portion of a thumb of a user, the thumb region comprising a knuckle area on a back side of the thumb region against which knuckles of the thumb of the user press when the user bends their thumb;

a finger region formed of at least an index finger region with a base;

a palm region formed of a first material extending from about a wrist end of the glove across about a palm area of the glove, wherein the palm region continues into a middle finger region, a ring finger region, and a little finger region;

a flexible region formed of material having greater flexibility than material forming the thumb region and the palm region;

wherein the flexible region at least substantially circumscribes uninterrupted around the base of the thumb region, extends upward from the thumb region into a first valley between the thumb region and the index finger region, up to the base of the index finger region, between the base of the thumb region and the palm region, and across a knuckle region on the back side of the golf glove defined by a location of four knuckles of the user's hand at the base of each of the user's fingers;

the index finger region coupling with a first fourchette, the index finger region and first fourchette coupling with the first valley at the base of the first fourchette;

a second fourchette formed by extending the first valley upward on the middle finger region of the golf glove;

a third fourchette directed on an opposite side of the middle finger region, wherein the third fourchette continues through a third valley between the middle finger region and the ring finger region and into a fourth fourchette on the ring finger region, a fifth fourchette directed on an opposite side of the ring finger region, wherein the fifth fourchette continues through a fourth valley between the ring finger region and the little finger region and into a sixth fourchette on a ring finger region; and a seventh fourchette that begins on an opposite side of the little finger region from the sixth fourchette:

wherein the thumb region comprises an auxiliary support structure coupled with the thumb region along a back side of the thumb region in an elongate shape extending from about the base region along a longitudinal length of the thumb region toward a tip of the thumb region and overlapping the knuckle area, and a stitch coupling the auxiliary support structure with the thumb region, the stitch only circumscribing the knuckle area not interfering with the knuckle area.

* * * * *